US005125371A

United States Patent [19]

Erickson et al.

[11] Patent Number: 5,125,371

[45] Date of Patent: Jun. 30, 1992

[54] SPRING DRIVEN HYDRAULIC ACTUATOR

[75] Inventors: Fredrick L. Erickson; William E. Richeson, both of Fort Wayne, Ind.

[73] Assignee: North American Philips Corporation, New York, N.Y.

[21] Appl. No.: 680,491

[22] Filed: Apr. 4 1991

[51] Int. Cl.[5] ..... F15B 13/044

[52] U.S. Cl. ..... 123/90.12; 91/459

[58] Field of Search ..... 123/90.11, 90.12; 137/625.64; 91/459, 465, 42

[56] References Cited

U.S. PATENT DOCUMENTS 4,974,495 12/1990 Richeson, Jr. ..... 123/90.12

5,022,358 6/1991 Richeson ..... 123/90.12

*Primary Examiner*—Noah P. Kamen

[57] ABSTRACT

An actuator which uses a double-ended hydraulic spring to propel an internal combustion engine poppet valve back and forth between a closed and an open positions. Timed delivery of supplemental pressure to a separate latching piston provides a means to fully "recock" the rebounding springs in each position. Activation is accomplished by releasing the supplemental pressure to allow the compressed fluid spring to propel the poppet valve in either one of two directions. A valve arrangement is also provided to allow a timed bypass of fluid around the latching piston during most of its transitioning to minimize the quantity of high pressure fluid consumption to that which is required to overcome friction losses.

12 Claims, 12 Drawing Sheets

SPRING DRIVEN HYDRAULIC ACTUATOR

SUMMARY OF THE INVENTION

The present invention relates generally to bistable actuators and more particularly to a two position, bistable, asymmetrical, fast acting, straight line motion actuator which uses a double-ended hydraulic spring to drive an internal combustion engine poppet valve back and forth between open and closed positions.

This actuator finds particular utility in opening and closing the gas exchange, i.e., intake or exhaust, valves of an otherwise conventional internal combustion engine. Due to its fast acting trait, the valves may be moved by the fluid pressure from the full closed to the full open position, and from the full open back to the full closed by the stored piston energy almost immediately rather than gradually as is characteristic of cam actuated valves. The actuator mechanism may find numerous other applications.

In U.S. Pat. Nos. 3,844,528 to Massie and 4,930,464 to Letsche there are shown electrically controlled hydraulically powered mechanisms for opening and closing an internal combustion engine poppet valves. Both suffer from long and therefor slow to react hydraulic lines. The Massie device is symmetric in its operation, that is, opening and closing of the engine valve occur in the same way. Massie employs a sleeve valve surrounding the power cylinder to selectively gate engine lubricating oil to the opposite sides of a power piston. In addition to the long and therefor slow to react hydraulic lines, the variable volume chambers on opposite sides of the power piston are relatively large and require excessive time to be filled and emptied when driving the valve back and forth. Massie is simply too slow to be an effective engine valve control. Letsche, except for a modification shown only in FIG. 7, is also symmetric in its operation. Letsche briefly opens the same control valve to initiate valve motion regardless of the direction of motion. This opening of the valve releases high pressure fluid from one piston face allowing a compressed one of two symmetric springs to drive the engine valve from one position to the other. As the valve approaches its second position, the other of the springs is compressed (and the first stretched) serving both to slow valve movement, and also to store potential energy for the return trip. As the valve is transitioning from one position to the other, fluid is allowed to flow from one piston face to the other by way of a bypass conduit. In the asymmetrical version of FIG. 7, Letsche applies additional force to open the engine valve by applying high pressure fluid to one end of the device.

In our U.S. Pat. No. 4,831,973 as well as the Richeson U.S. Pat. No. 4,883,025 and Gotschall U.S. Pat. No. 4,749,167 there is found a general teaching of the concept of employing a pneumatic damping piston for slowing the motion of an internal combustion engine valve near the completion of its traversal from one stable state to another, and subsequently utilizing the potential energy accumulated by the damping piston for powering the engine valve back toward the first of its stable states. These devices either employ an electromagnet or a permanent magnet in conjunction with a coil to temporarily neutralize the field of that permanent magnet as latching mechanisms for holding the valve in each of the two end positions. These devices are symmetrical in the sense that the same propulsive forces and the same damping forces occasioned by the same hardware are encountered regardless of the direction of travel.

In our copending application entitled SPRING DRIVEN HYDRAULIC ACTUATOR filed on even date herewith, there is disclosed an actuator which utilizes an air chamber to damp piston motion in either direction and then uses the just compressed air to power the piston back in the opposite direction. The invention of this copending application utilizes a hydraulic latch to hold the piston in one or the other extreme positions against the pneumatic force. The actuator of that application has a latching piston in a power module. The latching piston has an interconnecting shaft extending into a spring module in which a second piston functions as part of the hydraulic fluid spring assembly. The shaft extends beyond these modules and interconnects with an engine poppet valve. A shaft extension through the latching piston provides a means to power a reciprocating fluid control valve by means of interconnected helical springs. These springs provide forces on a latching armature which are in opposition to the forces applied to that armature by a pair of latching magnets.

In our copending application entitled PNEUMATIC PRELOADED ACTUATOR, Ser. No. 680,721 filed on even date herewith, there is disclosed an actuator having hydraulic latching at each extreme of its motion with a pneumatic spring which is cocked as a piston nears the end of each of its traversals to subsequently power the piston back in the other direction. Supplementary power to make up for system losses such as friction is supplied by supplemental hydraulic pressure being valved in to the latching chamber near the end of piston travel in one direction.

In Richeson U.S. Pat. No. 4,974,495 as well as the copending Richeson U.S. patent application Ser. No. 07/557,377 there are disclosed fast acting valve actuators for actuating intake or exhaust valves in internal combustion engines of a type which are hydraulically powered and command triggered. The actuators of these disclosures go a long way toward solving the problem of long hydraulic lines characteristic of devices such as disclosed in the above mentioned Letsche and Massie patents. These actuators include a cylinder with a power piston having a pair of opposed working surfaces or faces which is reciprocable within the cylinder along an axis between first and second extreme positions. A cylindrical control valve is located radially intermediate the reservoir and the cylinder, and is movable upon command to alternately supply high pressure fluid from a reservoir of high pressure hydraulic fluid to one face and then the other face of the power piston causing the piston to move from one extreme position to the other extreme position. The cylindrical control valve may be a shuttle valve which is reciprocable along the axis of the power piston between extreme positions with control valve motion along the axis in one direction being effective to supply high pressure fluid to move the piston in the opposite direction. Both the control valve and the piston are stable in both of their respective extreme positions and the control valve is spring biased toward a position intermediate the extreme positions. The latter portion of piston motion during one operation of the valve actuator is effective to cock this spring and bias the control valve preparatory to the next operation. A significant distinction between the patent and the pending application is that the patented arrangement utilizes high pressure hydraulic fluid to power the piston in each direction while the pending application utilizes an air chamber to damp piston motion in one direction and then uses the compressed air to power the piston back in the opposite direction.

The entire disclosures of all of the above identified copending applications and patents are specifically incorporated herein by reference.

In the last mentioned copending application, a piston is powered from a first (engine valve closed) position by high pressure hydraulic fluid in a manner similar to the abovementioned Richeson U.S. Pat. No. 4,974,495. As in that application, a relatively constant high pressure source is maintained close to the piston and the fluid ducting and valving path therebetween has a very high ratio of cross-section to length. This makes the valve very fast acting to open an engine valve and significantly reduces losses as compared to conventional hydraulic systems. As the piston approaches the engine valve-open position, the piston assembly including the engine valve are slowed or damped and piston assembly kinetic energy is converted to and stored as potential energy. This potential energy is subsequently utilized to drive the piston back to its initial or valve-closed position.

Also in the lastmentioned copending application, a hydraulic actuator utilizes a double hydraulic spring assembly, a power piston and a valve arrangement for supplying supplemental fluid under high pressure to the power piston. The actuator operates on the principle of holding an internal piston in either of two stable positions by valved-in high pressure fluid which provides a force opposing that of an external fluid spring. The valved-in pressure functions to cock the fluid spring in either of its two positions. The fluid springs are utilized as energy recovery devices and "bounce" the actuator piston back and forth between them with the supplemental pressure being added only toward the end of the travel to make certain that the actuator does transit its full distance and does fully re-cock the other fluid spring at the end of its travel. The supplemental pressure is valved-in behind the piston at the latest possible time to keep the overall transition efficiency as high as possible. The actuator will remain in either of its two rest positions as long as the supplemental pressure continues to apply a seating force to the actuator piston. To initiate a transition from one position to the other, the supplemental pressure is simply removed so that the energy stored in the fluid spring is released to power the actuator to its next position.

A significant distinction between the last mentioned patent and copending application on the one hand and the present invention on the other is that the prior arrangements utilize high pressure hydraulic fluid to power the piston in one or both directions while the present application utilizes a hydraulic chamber to damp piston motion in either directions and then uses the energy stored in the compressed hydraulic fluid to power the piston back in the opposite direction. The present invention utilizes a hydraulic latch to hold the piston in one or the other extreme positions against the hydraulic force.

In contradistinction to the earlier-described devices, the actuator of the present invention has a latching piston in a power module. This latching piston has an interconnecting shaft extending into a spring module in which a second piston functions as part of the hydraulic fluid spring assembly. The shaft extends beyond these modules and interconnects with an engine poppet valve. A shaft extension through the latching piston provides a means to power a reciprocating fluid control valve by means of interconnected helical springs. These springs provide forces on a latching armature which are in opposition to the forces applied to that armature by a pair of latching magnets.

Among the several objects of the present invention may be noted the provision of an actuator powered primarily by hydraulic fluid compressed while damping previous actuator motion; the provision of a bistable actuator having symmetric hydraulic damping and symmetric hydraulic latching; the provision of a poppet valve actuator of enhanced efficiency; the provision of an actuator employing a reciprocating hydraulic piston which functions both as a power piston and as a damping piston; and the provision of an electronically controllable hydraulically powered, hydraulically latched valve actuating mechanism for use in actuating the poppet valves of an internal combustion engine. These as well as other objects and advantageous features of the present invention will be in part apparent and in part pointed out hereinafter.

In general, a bistable engine valve actuator has a mechanism portion reciprocable between each of two stable positions and has a replenishable source of high pressure hydraulic fluid along with a latch symmetrically operable in each of the stable positions for temporarily preventing translation of the mechanism portion. The high pressure fluid source includes a cylinder having a pair of opposed fixed end walls, a pair of pistons reciprocable within the cylinder to define therewith three variable volume chambers, one comprising a high pressure source chamber between the pistons and one each functioning as low pressure relief chambers between a piston and one cylinder end wall, and a pair of compression springs interposed between a piston and a corresponding cylinder end wall for urging the pistons toward one another. The latch includes a latching piston having a pair of opposed faces and positioned closely adjacent the source of high pressure fluid, and a control valve for selectively supplying high pressure fluid to one of the latching piston faces thereby preventing translation of the portion of the mechanism which mechanism portion includes the latching piston. There is a first variable volume chamber in which hydraulic fluid is compressed during translation of the mechanism portion in one direction with compression of the fluid slowing the mechanism portion translation in that direction, and this first variable volume chamber retains the compressed fluid for later driving the mechanism portion back in an opposite direction. There is also a second variable volume chamber in which fluid is compressed during translation of the mechanism portion in opposite direction with compression of the fluid slowing the mechanism portion translation in said opposite direction. This second variable volume chamber also retains the compressed fluid for later driving the mechanism portion back in the first direction. A source of high pressure fluid is provided to maintain the minimum fluid pressure in the first and second variable chambers at least a predetermined level.

Also in general and in one form of the invention a bistable electronically controlled hydraulically driven, hydraulically latched transducer has an armature reciprocable between first and second positions with a hydraulic arrangement for holding the armature in each of the first and second positions. The hydraulic latching arrangement includes a bistable generally cylindrical control valve encircling at least a portion of the armature. This control valve is operable in one of its stable states to supply high pressure hydraulic fluid to force the armature in one direction and in the other of its stable states to supply high pressure hydraulic fluid to force the armature in an opposite direction. There is a first chamber in which fluid is compressed during motion of the armature from the first position to the second position with compression of the fluid slowing armature motion as it nears the second position and a similar second chamber in which fluid is compressed during motion of the armature from the second position to the first position. The control valve remains in one stable state to temporarily prevent reversal of armature motion when the motion of the armature has slowed to a stop later returning to the other of its stable states on command to allow the fluid compressed in the chamber to return the armature to the first position. A replenishable source of high pressure hydraulic fluid is located closely adjacent the armature and comprises a cylinder with a pair of opposed fixed end walls and a pair of pistons reciprocable within the cylinder to define therewith three variable volume chambers.

The chamber between the pistons functions as a high pressure source while those between the pistons and corresponding cylinder end walls function as low pressure relief chambers. A pair of compression springs urge the pistons toward one another.

Still further in general, a bistable electronically controlled transducer has an armature which is reciprocable between first and second positions. A first hydraulic arrangement powers the armature from the first position to the second position and a second hydraulic arrangement powers the armature from the second position back to the first position. A first hydraulic spring is compressed during motion of the armature from the first position to the second position with compression of the first hydraulic spring slowing armature motion as it nears the second position. A second hydraulic spring is compressed during motion of the armature from the second position to the first position with compression of the second hydraulic spring slowing armature motion as it nears the first position. The hydraulic arrangement maintains pressure on the armature to temporarily prevent reversal of armature motion when the motion of the armature has slowed to a stop, and is disableable on command to allow the compressed first hydraulic spring to return the armature to the first position or to allow the compressed second hydraulic spring to return the armature to the second position. In the preferred embodiment, the first hydraulic spring comprises the second hydraulic arrangement and the second hydraulic spring comprises the first hydraulic arrangement.

BRIEF DESCRIPTION OF THE DRAWING

FIGS. 1–6 show, in sequence, the operation of the actuator with like numbered "a" and "b" figures show the actuator in the same position, but with the sections being taken at right angles to one another along lines a—a and b—b respectively of FIG. 8. More particularly:

Corresponding reference characters indicate corresponding parts throughout the several views of the drawing.

Figure 1A:
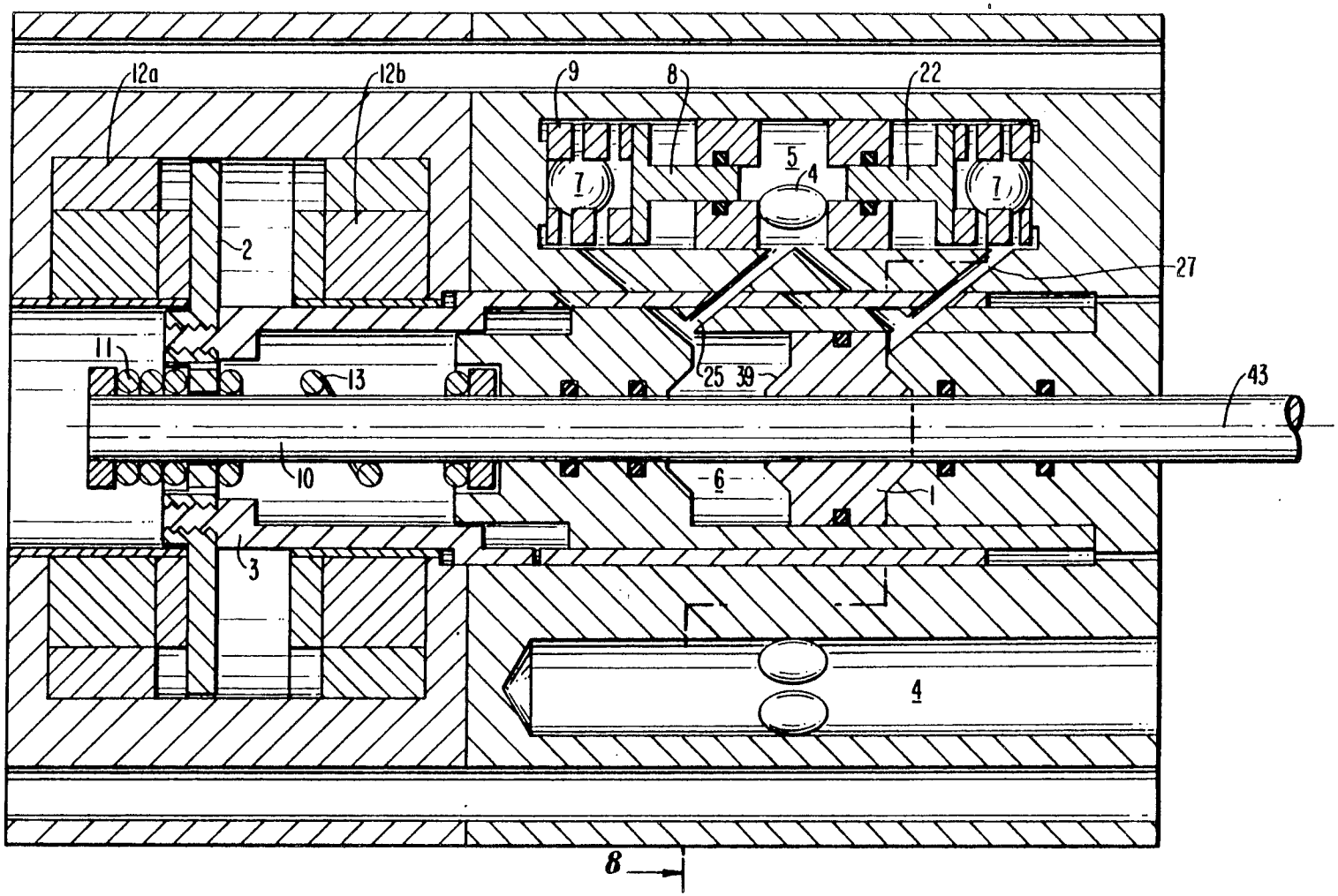
FIG. 1*a* is a longitudinal cross-section view of an actuator in the extended or "valve-open" position according to the invention in one form.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring to the drawings generally, an electronically controllable valve actuating mechanism is illustrated for use in an internal combustion engine of the type having engine intake and exhaust valves such as illustrative valve 21 with elongated valve stems such as 37. The actuator has a pair of stable positions corresponding to the engine valve open and engine valve closed positions respectively. The actuator includes a power piston 1 having a pair of opposed faces 39 and 41 defining variable volume chambers 6 and 23 respectively. Power piston 1 is reciprocable along axis 43 and is coupled to engine valve 21. A resilient damping arrangement which includes the power piston 1 symmetrically imparts a continuously increasing decelerating forces as the engine valve 21 approaches either of the valve-open and valve-closed positions. A hydraulic latching arrangement is operable on command to hold the power piston and engine valve in each of the stable positions and is operable on a subsequent command to allow the resilient damping means (in particular, the fluid pressure in chamber 15 or 16 of FIG. 7) to power the piston back from either of the valve-open and valve-closed positions to the other position. The commands take the form of electrical signals to coils 12*a* or 12*b* which neutralize the holding force of permanent magnets 29 and 31. The damping means (FIG. 7) comprises a cylinder having a pair of opposed closed end walls 45 and 47 within which the power piston 14 reciprocates. Piston 14 defines two variable volume chambers 15 and 16 the sum of the volumes of which is substantially constant. The mechanism further including a coil compression spring 17 for urging the power piston 14 and shaft 10 in a direction to close the corresponding engine valve 21.

Figure 4A:
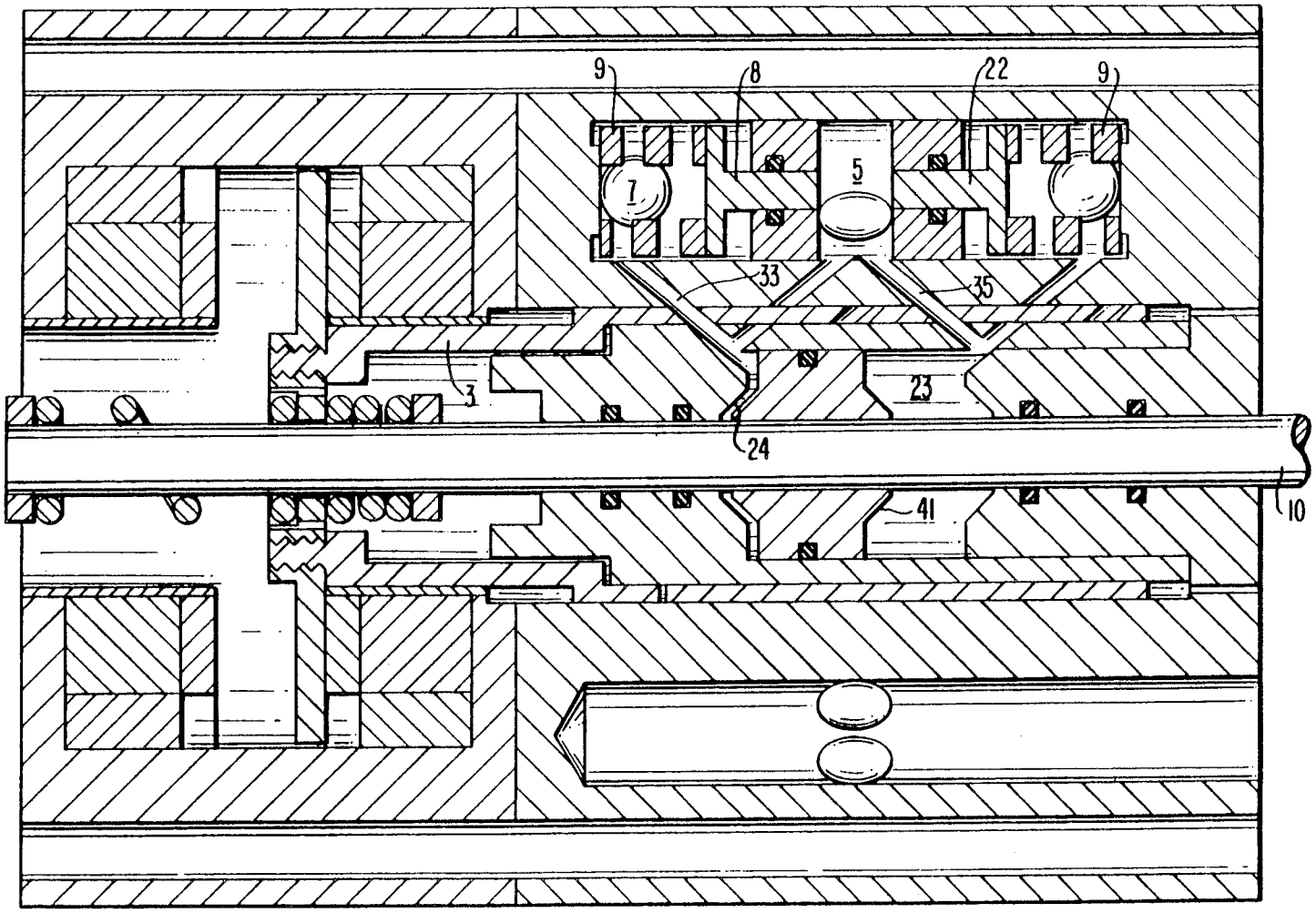
FIG. 4*a* is a cross-sectional view along the same line as FIG. 1*a*, but with the fluid valve having opened the high pressure/low pressure ports to provide times supplemental power from the accumulator to drive the piston all the way to the left.

The hydraulic latch includes a hydraulic cylinder and latching piston 1 which is fixed by common shaft 10 to the power piston 14 and moves within the cylinder to define in conjunction therewith a pair of variable volume chambers 6 and 23. A control valve 3 regulates the escape of hydraulic fluid from these variable volume chambers. The control valve is of a generally cylindrical shape coaxial with axis 43 and at least partially surrounds the latching piston 1. The actuator is primarily powered by fluid acting on power piston 14. FIGS. 1*a* and 4*a* show that, at a point near the extreme positions of piston 1, motive force from the hydraulic pressure on latching piston 1 is applied to force the mechanism in either extreme position so as to cock the hydraulic spring.

Figure 1B:
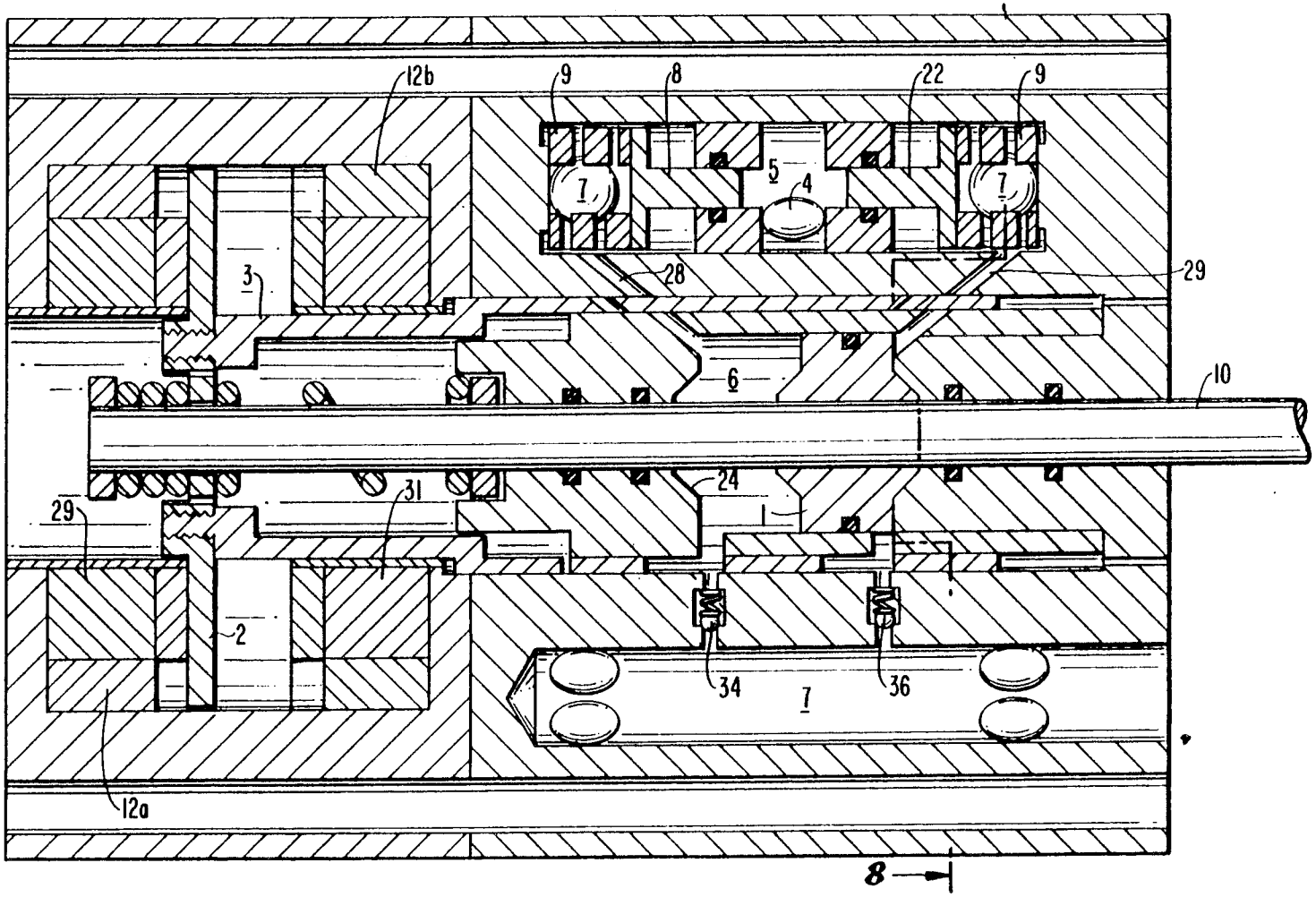
FIG. 1*b* is a cross-sectional view similar to FIG. 1*a*, but showing the low pressure galley valving.
Figure 6A:
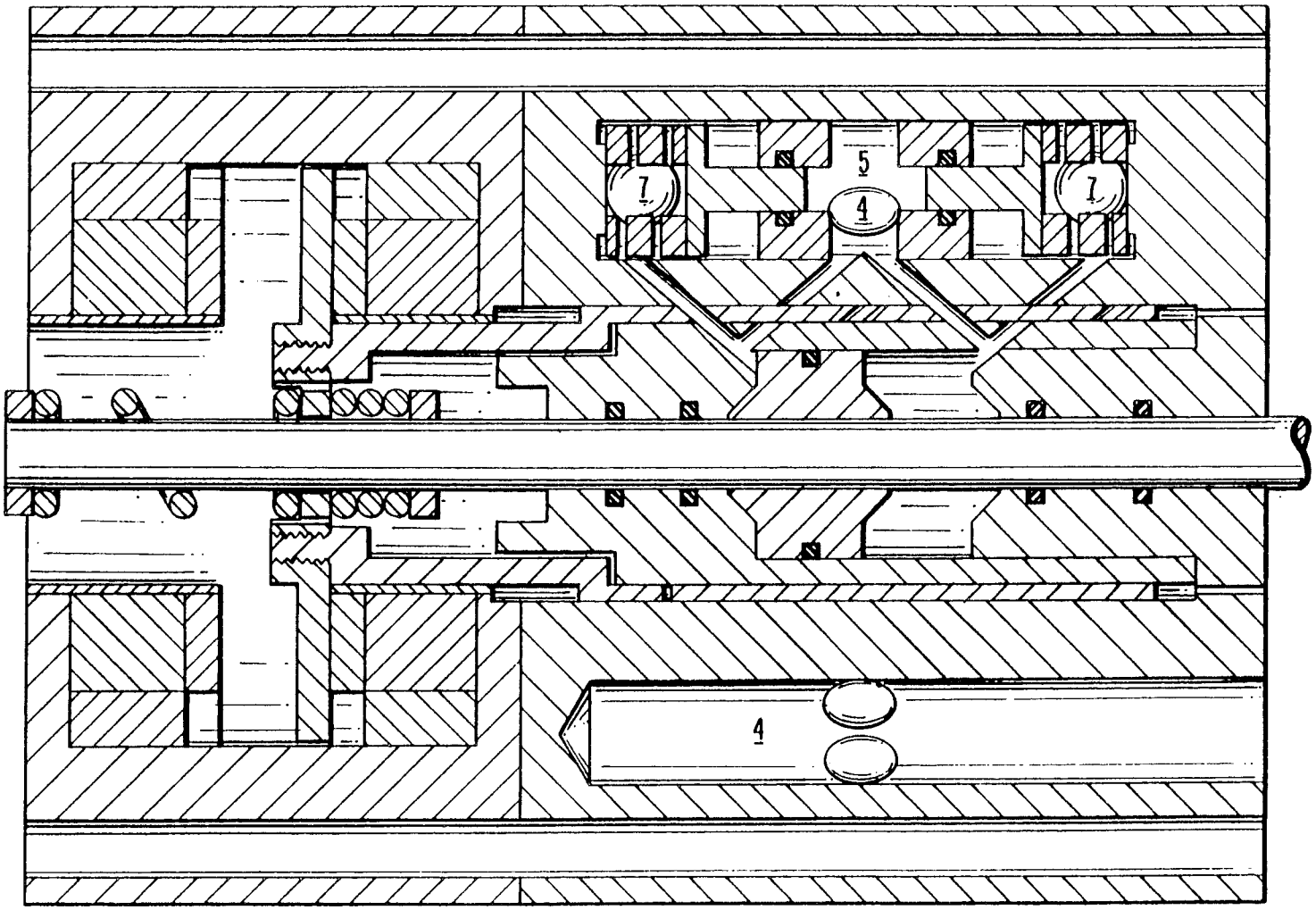
FIG. 6*a* is a cross-sectional view along the same line as FIG. 1*a*, but showing the accumulator pistons fully recharged and ready for the next transit.

The actuator has a double acting return spring (shown in FIG. 7) with that spring being maximally compressed in FIGS. 1 and 6, the extreme right and left positions of the latching piston 1 respectively. In FIG. 1, the actuator piston 1 is in the extreme position to the right with latch plate 2 and control valve 3 in their leftmost positions. Notice that the helical spring 13 is extended and the helical spring 11 is compressed, both stressed and ready to drive the latch plate 2 and the control valve 3 toward the right when coil 12*a* is energized. In FIGS. 1*a* and 1*b*, the control valve 3 allows high pressure fluid from galley 4 to enter cylinder 5 and pass down conduit 25 on into chamber 6 forcing piston 1 toward the right. The right side of piston 1 is vented through conduit 27 to the low pressure fluid sink 7. The high pressure in cavity 5 working against the low (sink 7) pressure on the outboard faces of pistons 8 drives those pistons away from one another compressing the springs 9 in FIGS. 1*a* and 1*b*.

Figure 2A:
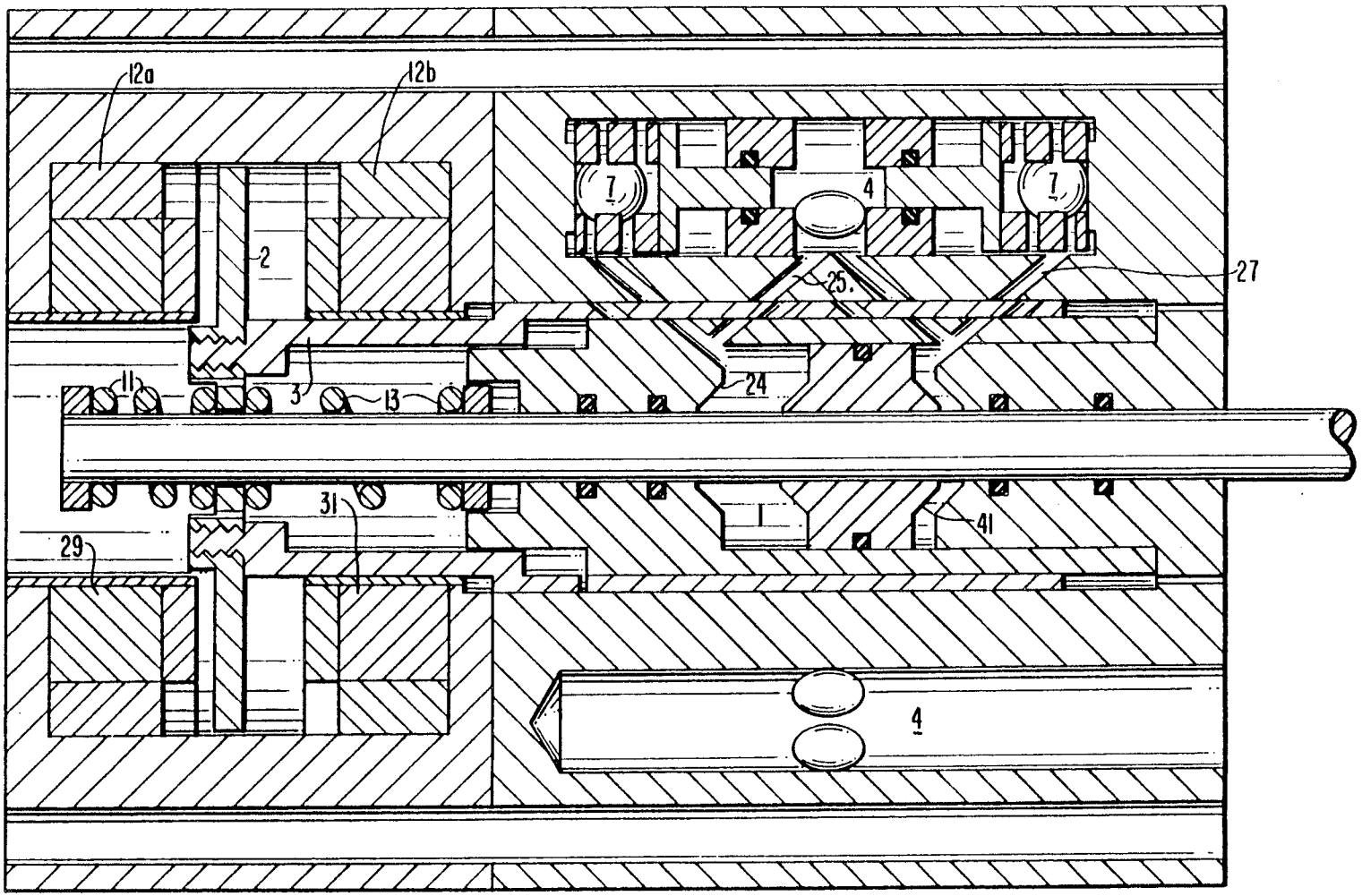
FIG. 2*a* is a cross-sectional view along the same line as FIG. 1*a*, showing the actuator with the fluid valve released to the right shutting off high pressure fluid to the left face of the latching piston.
Figure 2B:
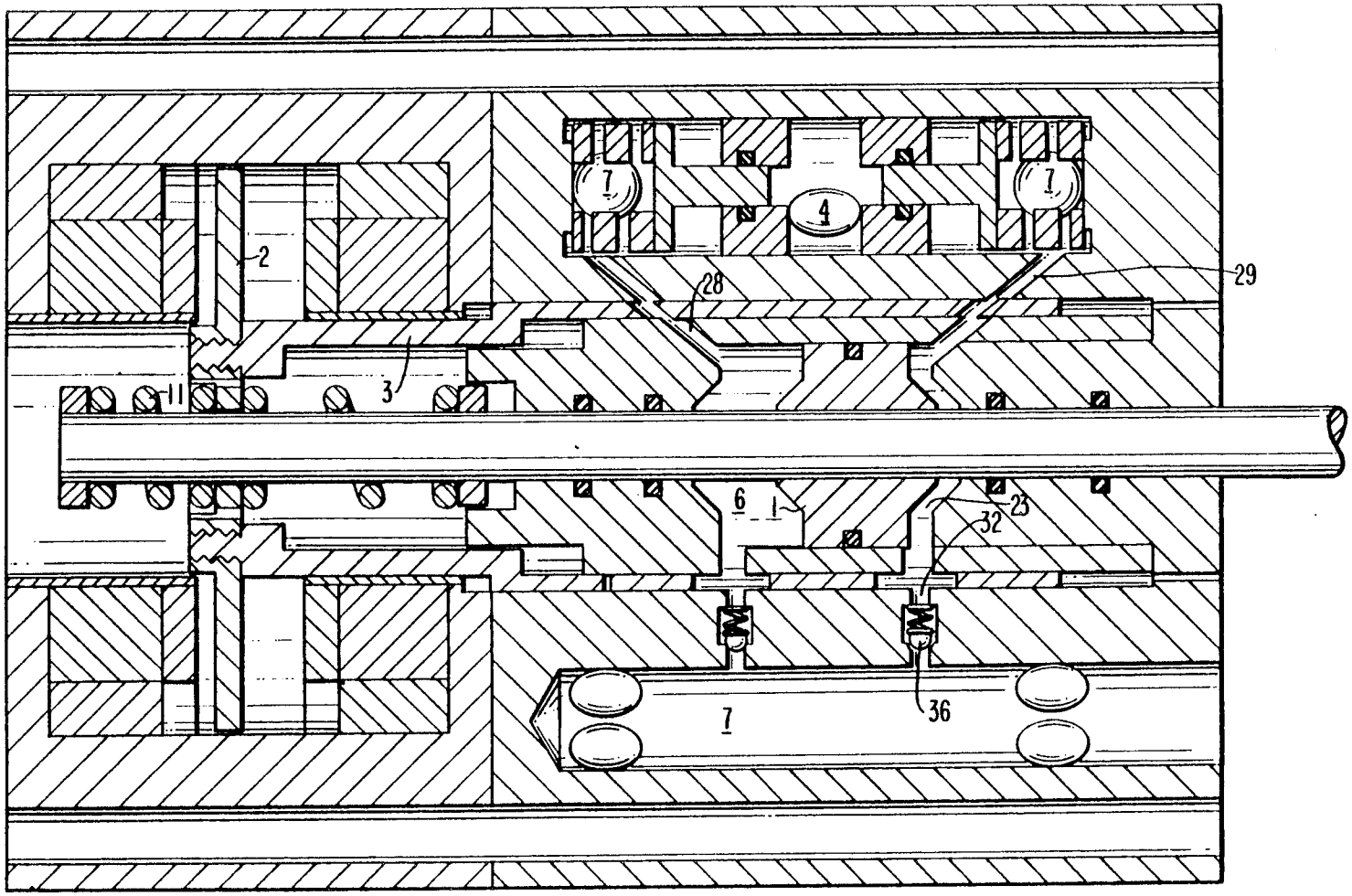
FIG. 2*b* is a cross-sectional view along the same line as FIG. 1*b* showing fluid flow around the piston by way of the fluid galley.

In FIG. 2*a*, the coil 12*a* has been energized neutralizing the holding force of permanent magnet 29, and the ferromagnetic plate 2 and control valve 3 are being propelled toward the right by the combined efforts of the springs 11 which is expanding toward its unstressed state and 13 which is contracting toward its unstressed state, and the attractive force of permanent magnet 31 on the plate 2. As the control valve 3 moves toward the right, it closes both conduits 27 and 25. At the same time, a comparison of FIGS. 1*b* and 2*b* reveals shows that valve 3 also ports both sides of the latching piston 1 to the low pressure galley 7 by way of ports 28 and 29. Fluid races from the left to the right side of piston 1 as the spring (FIG. 7) drives the piston toward the left in FIG. 2*a*. Check valve 36 opens to supply low pressure fluid to cavity 23 as piston 1 moves to the left.

Motion of the piston 1, latch plate 2 and shaft 10 continues expanding spring 11 and compressing the spring 13. Later on in a following cycle, spring 13 will propel plate 2 and valve 3 back toward the left. Thus, motion of piston 1 generates the force for driving the armature plate 2 that will properly valve the actuator upon command sent to latch coils 12*a* and 12*b*.

Figure 7:
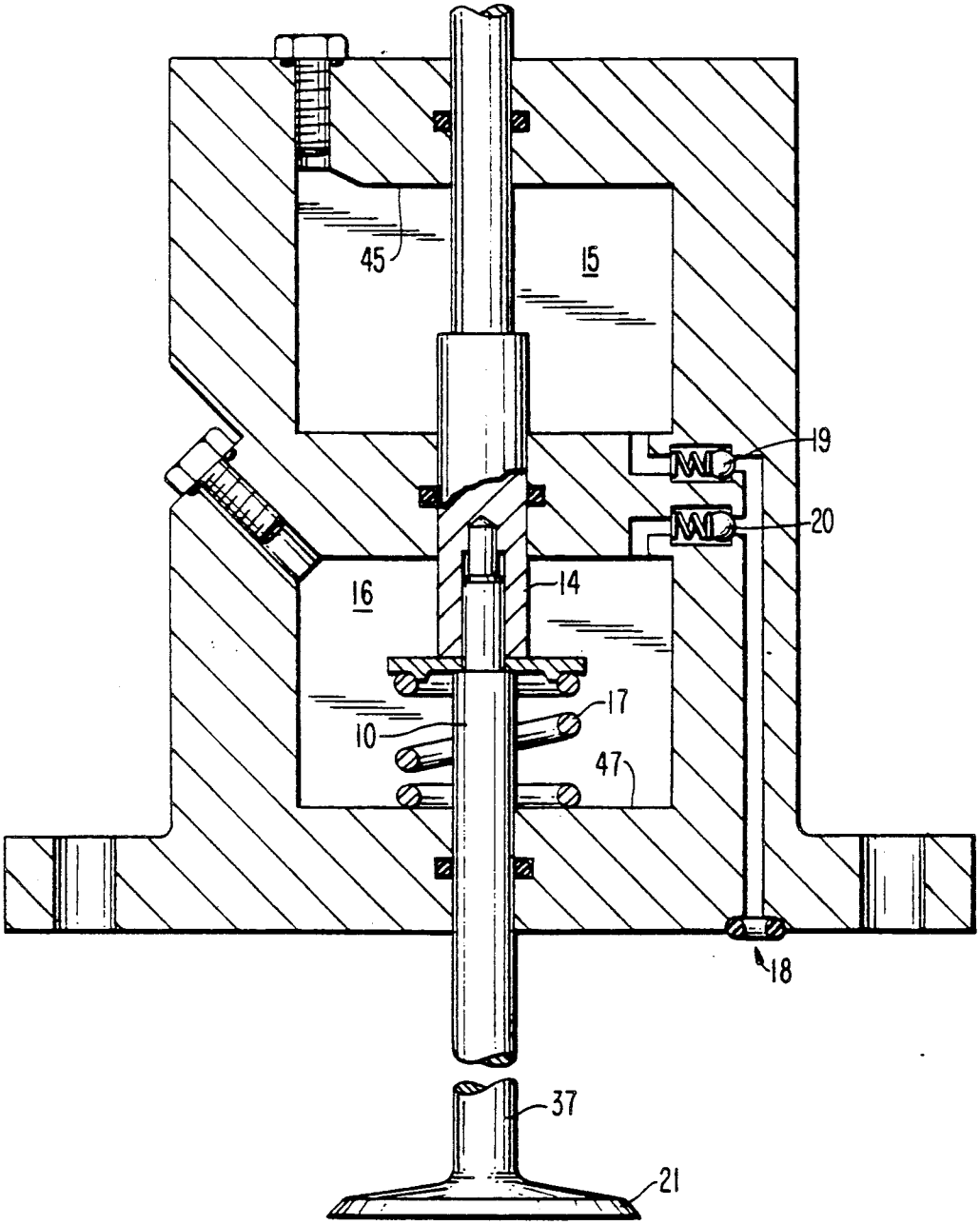
FIG. 7 illustrates the double ended hydraulic fluid spring assembly about midway in position.
Figure 8:
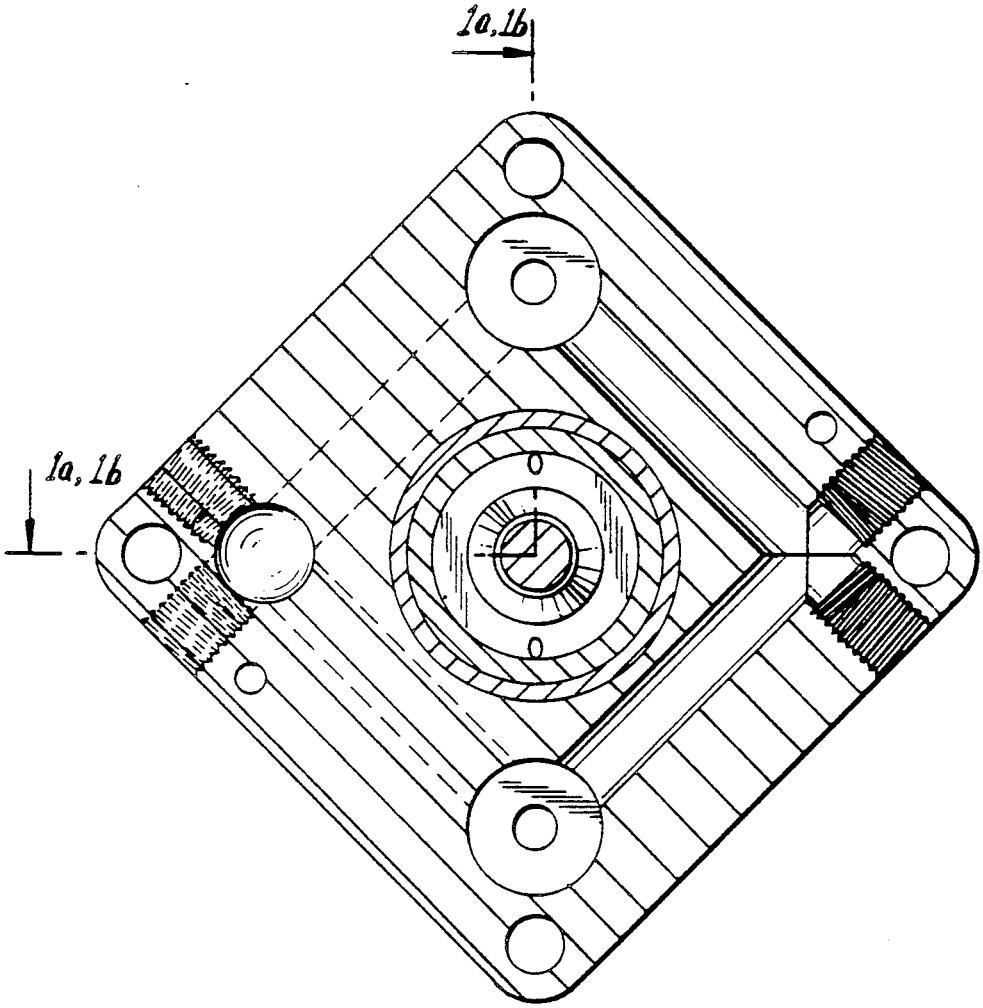
FIG. 8 is a view in cross-section along lines 8—8 of FIG. 1*a*.

The force causing piston 1 to move to the left is derived by the differential pressure in cavities 15 and 16 shown in FIG. 7. This differential pressure acts on the differential area between segments 10 and 14 of the shaft which compresses or expands the fluid in cavities 15 and 16. When the shaft is in one or the other extreme position, one pressure is maximum and the other is minimal. Fluid source 18 supplies make-up hydraulic fluid through one-way check valves 19 and 20 thereby setting the minimal pressure at that of the source. This minimal pressure is selected so as to prevent cavitation of the fluid in chambers 15 and 16.

Figure 3A:
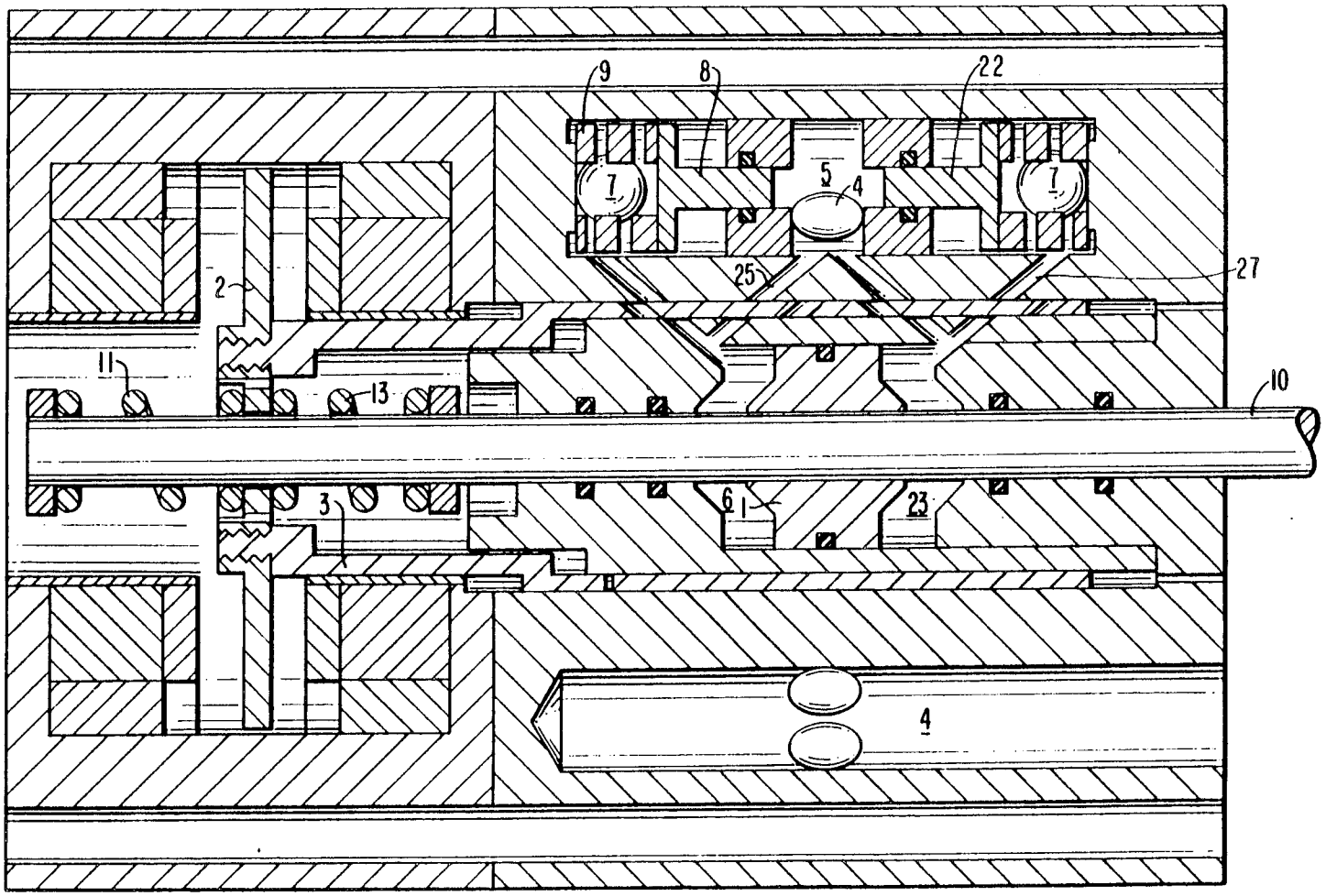
FIG. 3*a* is a cross-sectional view along the same line as FIG. 1*a*, but showing the piston about midway in its travel and with all high pressure to the piston shut off.
Figure 3B:
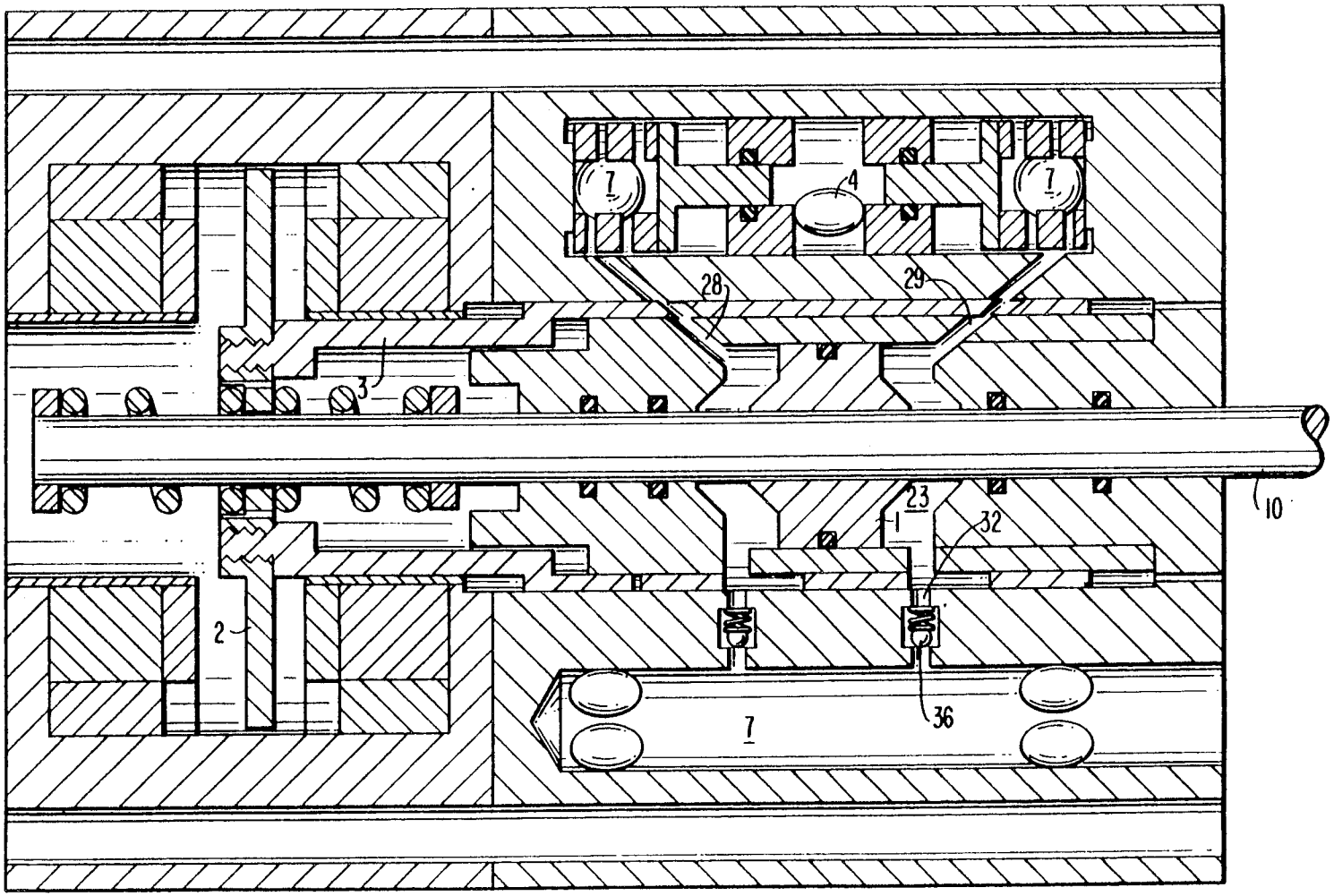
FIG. 3*b* is a cross-sectional view along the same line as FIG. 1*b*, but showing the piston displacing the fluid into the low pressure galley and fluid return to the back side of the piston as the fluid valve continues to move to the right.

FIGS. 3*a* and 3*b* illustrate the valve 3 and piston 1 progressing into the final state which will seat poppet valve 21. It should be remembered that the bidirectional fluid spring mechanism of FIG. 7 will be interposed between the valve 21 and the other structure of FIG. 3. The hydraulic valve ports of conduits such as 25 and 27 of valve 3 which are visible in FIG. 3*a* remain closed while those shown in FIG. 3*b* (28 and 29) remain open as the double acting spring 17 moves the shaft 10 to the left. Check valve 36 also remains open during this time to supply low pressure fluid to cavity 23 allowing free movement of piston 1.

Figure 4B:
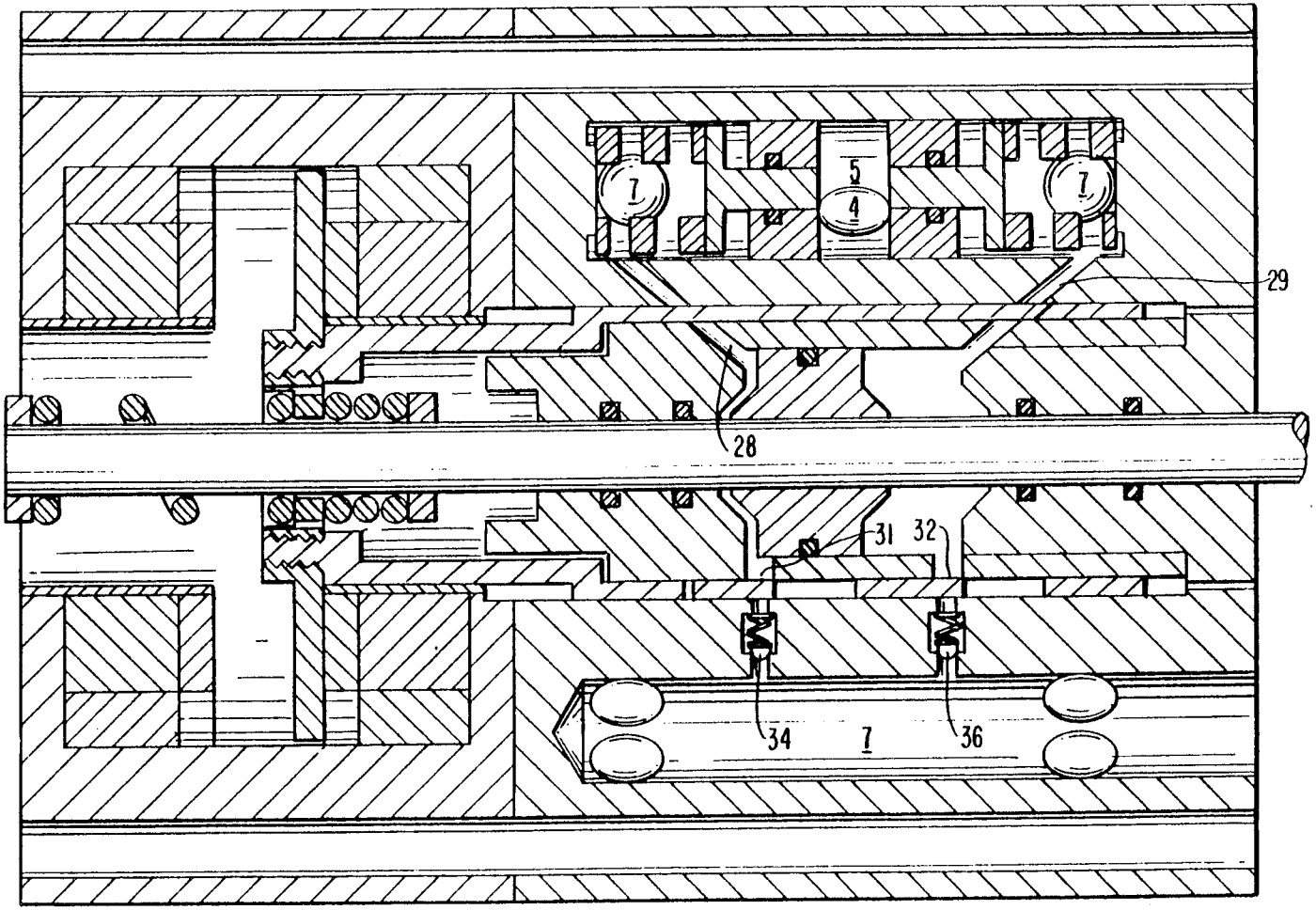
FIG. 4*b* a cross-sectional view along the same line as FIG. 1*b*, but the valving has now shut off the low pressure galley from the piston.
Figure 5A:
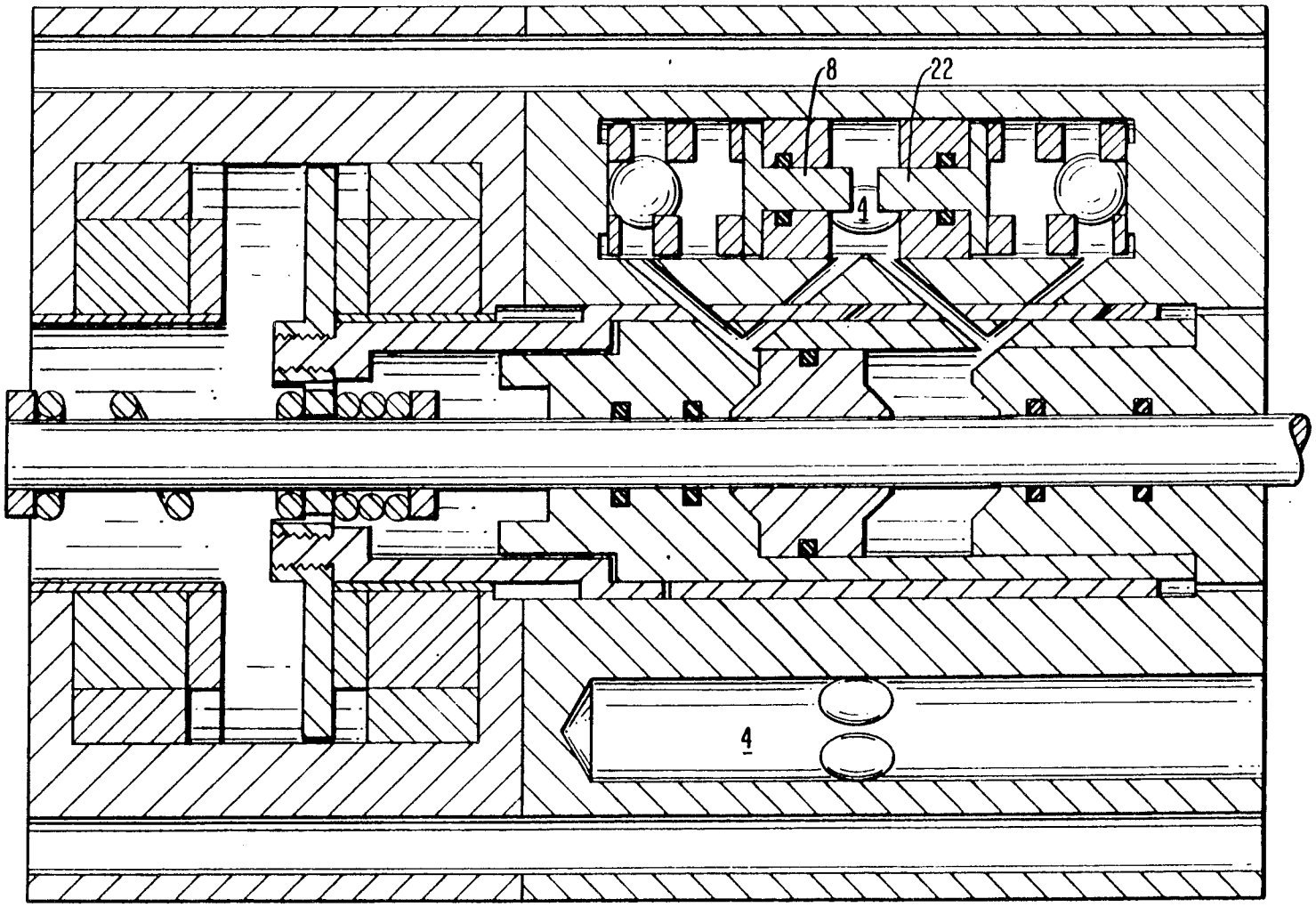
FIG. 5*a* is a cross-sectional view along the same line as FIG. 1*a* showing how the accumulator pistons have now expended their high pressure fluid and are ready to be recharged.

In FIG. 4*a*, the high pressure source is now ported from cavity 5 into chamber 23 on the right side of piston 1 and closes check valve port 32 and check valve 36 while the cavity 6 on the left (advancing) face of piston 1 is ported by way of conduit 33 to the low pressure chamber 7. This late portion of high pressure hydraulic fluid into cavity 23 supplies the fluid to move piston 1 into the final position of its motion to the left, thus using only a small volume of high pressure fluid and hence a much reduced amount of hydraulic energy. This pressurization of cavity 23 causes the spring 17 of FIG. 7 to be cocked toward one extreme position and the pressure in cavity 15 to peak, both tending to slow or damp the final closing of poppet valve 21. The pressure in cavity 15 acts on the difference between the circular cross-sectional areas of shaft 10 and enlarged portion 14. Similarly, the pressure in cavity 16 acts in an opposite direction on the difference between these two areas. The peak pressure differential between cavities 15 and 16 operating on the differential area of shaft 10 and shaft portion 14 will supply the force to open poppet valve 21 on the next transition. The hydraulic ports of control valve 3 visible in FIG. 4*a* are now open while those visible in FIG. 4*b* are closed. This short term supply of fluid via conduit 35 and sinking via conduit 33 are made possible mainly from the differential motion of pistons 8 and 22 collapsing toward one another under the urging of springs 9. This is apparent from a comparison of FIGS. 3*a* and 4*a*.

As piston 1 is driven to its full limit toward the left, damping of the motion of shaft 10 and gentle seating of poppet valve 21 occurs as the piston 1 approaches its seat 24 and chamber 6 shrinks to essentially zero volume. This damping is due in part by the spring 17 of FIG. 7 being compressed and absorbing the kinetic energy of actuator motion. In the transition from FIG. 4*a* to FIG. 5*a* it will be observed that the pistons 8 and 22 reach their near limit of collapsing motion by the time engine poppet valve 21 is seated. A short time later the pistons 8 and 22 are re-cocked (expanded away from one another compressing springs 9) by an external pump which supplies high pressure hydraulic fluid to galley 4. This pump has a low pressure return from galley 7. This scheme of sourcing and sinking the hydraulic fluid via the chambers containing pistons 8 and 22 provides very fast fluid action with slower recharging of these chambers between actuator transitions.

An analogous sequence of events occurs in moving piston 1 to the right in these figures thus unseating and opening valve 21. The goal of greatly reducing the required external energy to open and close the valve has been attained.

From the foregoing, it is now apparent that a novel hydraulic spring driven actuator has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follows.

What is claimed is:

1. A bistable actuator having a mechanism portion reciprocable between each of two stable positions and comprising:

a replenishable source of high pressure hydraulic fluid;

means symmetrically operable in each of the stable positions for temporarily preventing translation of the mechanism portion including a latching piston having a pair of opposed faces and positioned closely adjacent the source of high pressure fluid, and a control valve for selectively supplying high pressure fluid to one of the latching piston faces thereby preventing translation of the portion of the mechanism including the latching piston;

a first variable volume chamber in which fluid is compressed during translation of the mechanism portion in one direction, compression of the fluid slowing the mechanism portion translation in said one direction, said first variable volume chamber retaining the compressed fluid to drive the mechanism portion back in a direction opposite said one direction;

a second variable volume chamber in which fluid is compressed during translation of the mechanism portion in said opposite direction, compression of the fluid slowing the mechanism portion translation in said opposite direction, said second variable volume chamber retaining the compressed fluid to drive the mechanism portion back in said one direction; and a source of high pressure fluid for maintaining the minimum fluid pressure in the first and second variable chambers at least a predetermined level.

2. The bistable actuator mechanism of claim 1 wherein the replenishable source of high pressure hydraulic fluid comprises a cylinder having a pair of opposed fixed end walls, a pair of pistons reciprocable within the cylinder to define therewith three variable volume chambers, one comprising a high pressure source chamber between the pistons and one each functioning as low pressure relief chambers between a piston and one cylinder end wall, and a pair of compression springs for urging the pistons toward one another, each compression spring being interposed between a piston and a corresponding cylinder end wall.

3. An electronically controllable valve actuating mechanism for use in an internal combustion engine of the type having engine intake and exhaust valves with elongated valve stems, the actuator having a pair of stable positions and comprising;

a power piston having a pair of opposed faces defining variable volume chambers, the power piston being reciprocable along an axis and adapted to be coupled to an engine valve;

resilient damping means including the power piston for symmetrically imparting continuously increasing decelerating forces as the engine valve approaches either of the valve-open and valve-closed positions;

hydraulic means operable on command for holding the power piston and engine valve in each of the stable positions, and operable on a subsequent command to allow the resilient damping means to power the piston back from either of the valve-open and valve-closed positions to the other position.

4. The electronically controllable valve actuating mechanism of claim 3 wherein the resilient damping means comprises a cylinder having a pair of opposed closed end walls within which the power piston reciprocates defining two variable volume chambers, the sum of the volumes of which is substantially constant, the mechanism further including a coil compression spring for urging the power piston in a direction to close the corresponding engine valve.

5. The electronically controllable valve actuating mechanism of claim 3 wherein the hydraulic means comprises a hydraulic cylinder and a latching piston fixed to the power piston and movable within the cylinder to define in conjunction therewith a pair of variable volume chambers, and a control valve for controlling the escape of hydraulic fluid from the chambers.

6. The electronically controllable valve actuating mechanism of claim 5 wherein the control valve is of a generally cylindrical shape and at least partially surrounds the latching piston.

7. A bistable electronically controlled hydraulically driven, hydraulically latched transducer having an armature reciprocable between first and second positions, hydraulic means for holding the armature in each of the first and second positions said hydraulic means including a bistable generally cylindrical control valve surrounding at least a portion of the armature, the control valve being operable in one of its stable states to supply high pressure hydraulic fluid to force the armature in one direction and in the other of its stable states to supply high pressure hydraulic fluid to force the armature in an opposite direction, a first chamber in which fluid is compressed during motion of the armature from the first position to the second position, compression of the fluid slowing armature motion as it nears the second position, a second chamber in which fluid is compressed during motion of the armature from the second position to the first position, compression of the fluid slowing armature motion as it nears the first position, the control valve remaining in said one stable state to temporarily prevent reversal of armature motion when the motion of the armature has slowed to a stop, the control valve returning to the other of its stable states on command to allow the fluid compressed in the chamber to return the armature to the first position.

8. The bistable electronically controlled hydraulically driven, hydraulically latched transducer of claim 7 wherein the hydraulic means further includes a replenishable source of high pressure hydraulic fluid closely adjacent the armature and comprising a cylinder having a pair of opposed fixed end walls, a pair of pistons reciprocable within the cylinder to define therewith three variable volume chambers, one comprising a high pressure source chamber between the pistons and one each functioning as low pressure relief chambers between a piston and one cylinder end wall, and a pair of compression springs for urging the pistons toward one another, each compression spring being interposed between a piston and a corresponding cylinder end wall.

9. A bistable electronically controlled transducer having an armature reciprocable between first and second positions, first hydraulic means for powering the armature from the first position to the second position, second hydraulic means for powering the armature from the second position back to the first position, a first hydraulic spring which is compressed during motion of the armature from the first position to the second position, compression of the first hydraulic spring slowing armature motion as it nears the second position, a second hydraulic spring which is compressed during motion of the armature from the second position to the first position, compression of the second hydraulic spring slowing armature motion as it nears the first position, hydraulic means maintaining pressure on the armature to temporarily prevent reversal of armature motion when the motion of the armature has slowed to a stop, the hydraulic means being disableable on command to allow the compressed first hydraulic spring to return the armature to the first position and disableable on command to allow the compressed second hydraulic spring to return the armature to the second position.

10. The bistable electronically controlled transducer of claim 9 wherein the first hydraulic spring comprises the second hydraulic means and the second hydraulic spring comprises the first hydraulic means.

11. An electronically controllable valve actuating mechanism for use in an internal combustion engine of the type having engine intake and exhaust valves with elongated valve stems, the actuator having a pair of stable positions and comprising;

a power piston having a pair of opposed faces defining variable volume chambers, the power piston being reciprocable along an axis and adapted to be coupled to an engine valve;

hydraulic damping means including the power piston for imparting a continuously increasing decelerating force as the engine valve approaches either of the valve-open and valve-closed positions;

hydraulic means operable on command for holding the power piston and engine valve in each of the stable positions, and operable on command to allow the hydraulic damping means to power the piston back from either of the valve-open and valve-closed positions to the other position; and a high pressure hydraulic fluid source operable when the engine valve is near either one of the valve-open and valve-closed positions for forcing the power piston and engine valve into a stable position.

12. The electronically controllable valve actuating mechanism of claim 11 wherein the hydraulic damping means converts kinetic energy of the moving piston and engine valve into potential energy during damping and utilizes that potential energy to propel the power piston in the opposite direction on the next subsequent command to power the piston back from either of the valve-open and valve-closed positions to the other position.

* * * * *